US008376047B2

(12) United States Patent
Dykstra et al.

(10) Patent No.: US 8,376,047 B2
(45) **Date of Patent: *Feb. 19, 2013**

(54) VARIABLE FLOW RESTRICTOR FOR USE IN A SUBTERRANEAN WELL

(75) Inventors: Jason D. Dykstra, Carrollton, TX (US); Michael L. Fripp, Carrollton, TX (US); Luke W. Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/430,507

(22) Filed: Mar. 26, 2012

(65) Prior Publication Data

US 2012/0181037 A1 Jul. 19, 2012

Related U.S. Application Data

(63) Continuation of application No. 12/869,836, filed on Aug. 27, 2010.

(51) Int. Cl.
*E21B 34/00* (2006.01)

(52) U.S. Cl. ..... 166/316; 166/319; 137/808; 137/812

(58) Field of Classification Search ..... 166/320, 166/278, 51, 227, 205, 319, 370, 242.1, 316; 137/808, 809, 812, 834
See application file for complete search history.

(56) References Cited

U.S. PATENT DOCUMENTS

| | | | | |
|---|---|---|---|---|
| 3,091,393 | A | | 5/1963 | Sparrow |
| 3,216,439 | A | | 11/1965 | Manion |
| 3,233,621 | A | | 2/1966 | Manion |
| 3,256,899 | A | | 6/1966 | Dexter et al. |
| 3,282,279 | A | | 11/1966 | Manion |
| 3,461,897 | A | | 8/1969 | Kwok |
| 3,470,894 | A | | 10/1969 | Rimmer |
| 3,474,670 | A | * | 10/1969 | Rupert ..... 73/861.32 |
| 3,489,009 | A | | 1/1970 | Rimmer |
| 3,515,160 | A | | 6/1970 | Cohen |
| 3,529,614 | A | | 9/1970 | Nelson |
| 3,537,466 | A | | 11/1970 | Chapin |
| 3,566,900 | A | | 3/1971 | Black |
| 3,586,104 | A | | 6/1971 | Hyde |
| 3,598,137 | A | | 8/1971 | Glaze |

(Continued)

FOREIGN PATENT DOCUMENTS

| | | |
|---|---|---|
| EP | 0834342 A2 | 4/1998 |
| EP | 1857633 A2 | 11/2007 |

(Continued)

OTHER PUBLICATIONS

International Search Report with Written Opinion issued Apr. 17, 2012 for PCT Patent Application No. PCT/US11/050255, 9 pages.

(Continued)

*Primary Examiner* — Nicole Coy
(74) *Attorney, Agent, or Firm* — Smith IP Services, P.C.

(57) ABSTRACT

A variable flow resistance system for use in a subterranean well can include a flow chamber through which a fluid composition flows, the chamber having at least one inlet, an outlet, and at least one structure spirally oriented relative to the outlet, whereby the structure induces spiral flow of the fluid composition about the outlet. Another variable flow resistance system for use in a subterranean well can include a flow chamber including an outlet, at least one structure which induces spiral flow of a fluid composition about the outlet, and at least one other structure which impedes a change in direction of flow of the fluid composition radially toward the outlet.

11 Claims, 5 Drawing Sheets

U.S. PATENT DOCUMENTS

| | | | | |
|---|---|---|---|---|
| 3,620,238 | A | 11/1971 | Kawabata | |
| 3,670,753 | A | 6/1972 | Healey | |
| 3,704,832 | A | 12/1972 | Fix et al. | |
| 3,712,321 | A * | 1/1973 | Bauer | 137/812 |
| 3,717,164 | A | 2/1973 | Griffin | |
| 3,942,557 | A | 3/1976 | Tsuchiya | |
| 4,029,127 | A | 6/1977 | Thompson | |
| 4,082,169 | A | 4/1978 | Bowles | |
| 4,127,173 | A | 11/1978 | Watkins et al. | |
| 4,276,943 | A | 7/1981 | Holmes | |
| 4,286,627 | A | 9/1981 | Graf | |
| 4,291,395 | A | 9/1981 | Holmes | |
| 4,307,653 | A | 12/1981 | Goes et al. | |
| 4,323,991 | A | 4/1982 | Holmes et al. | |
| 4,385,875 | A | 5/1983 | Kanazawa | |
| 4,418,721 | A | 12/1983 | Holmes | |
| 4,557,295 | A | 12/1985 | Holmes | |
| 4,895,582 | A * | 1/1990 | Bielefeldt | 55/337 |
| 5,303,782 | A | 4/1994 | Johannessen | |
| 5,455,804 | A | 10/1995 | Holmes et al. | |
| 5,505,262 | A | 4/1996 | Cobb | |
| 6,015,011 | A | 1/2000 | Hunter | |
| 6,112,817 | A * | 9/2000 | Voll et al. | 166/370 |
| 6,345,963 | B1 | 2/2002 | Thomin et al. | |
| 6,367,547 | B1 | 4/2002 | Towers et al. | |
| 6,371,210 | B1 | 4/2002 | Bode et al. | |
| 6,497,252 | B1 | 12/2002 | Kholer et al. | |
| 6,622,794 | B2 * | 9/2003 | Zisk, Jr. | 166/373 |
| 6,627,081 | B1 | 9/2003 | Hilditch et al. | |
| 6,644,412 | B2 | 11/2003 | Bode et al. | |
| 6,691,781 | B2 | 2/2004 | Grant et al. | |
| 6,719,048 | B1 | 4/2004 | Ramos et al. | |
| 6,913,079 | B2 | 7/2005 | Tubel | |
| 7,185,706 | B2 | 3/2007 | Freyer | |
| 7,290,606 | B2 | 11/2007 | Coronado et al. | |
| 7,409,999 | B2 | 8/2008 | Henriksen et al. | |
| 7,537,056 | B2 | 5/2009 | MacDougall | |
| 7,578,343 | B2 | 8/2009 | Augustine | |
| 7,621,336 | B2 | 11/2009 | Badalamenti et al. | |
| 7,828,067 | B2 | 11/2010 | Scott et al. | |
| 7,857,050 | B2 * | 12/2010 | Zazovsky et al. | 166/278 |
| 8,127,856 | B1 | 3/2012 | Nish et al. | |
| 2006/0131033 | A1 | 6/2006 | Bode et al. | |
| 2007/0028977 | A1 | 2/2007 | Goulet | |
| 2007/0246407 | A1 | 10/2007 | Richards et al. | |
| 2008/0041580 | A1 | 2/2008 | Freyer et al. | |
| 2008/0041581 | A1 | 2/2008 | Richards | |
| 2008/0041582 | A1 | 2/2008 | Saetre et al. | |
| 2008/0041588 | A1 * | 2/2008 | Richards et al. | 166/265 |
| 2008/0149323 | A1 | 6/2008 | O'Malley et al. | |
| 2008/0169099 | A1 | 7/2008 | Pensgaard et al. | |
| 2008/0283238 | A1 | 11/2008 | Richards et al. | |
| 2008/0314590 | A1 * | 12/2008 | Patel | 166/278 |
| 2009/0000787 | A1 | 1/2009 | Hill et al. | |
| 2009/0065197 | A1 | 3/2009 | Eslinger | |
| 2009/0078427 | A1 | 3/2009 | Patel | |
| 2009/0078428 | A1 | 3/2009 | Ali | |
| 2009/0101354 | A1 | 4/2009 | Holmes et al. | |
| 2009/0120647 | A1 | 5/2009 | Turick et al. | |
| 2009/0133869 | A1 | 5/2009 | Clem | |
| 2009/0151925 | A1 | 6/2009 | Richards et al. | |
| 2009/0250224 | A1 | 10/2009 | Wright et al. | |
| 2009/0277650 | A1 | 11/2009 | Casciaro et al. | |
| 2011/0042091 | A1 | 2/2011 | Dykstra et al. | |
| 2011/0042092 | A1 | 2/2011 | Fripp et al. | |
| 2011/0079384 | A1 * | 4/2011 | Russell et al. | 166/228 |
| 2011/0186300 | A1 | 8/2011 | Dykstra et al. | |
| 2011/0198097 | A1 | 8/2011 | Moen | |
| 2011/0214876 | A1 | 9/2011 | Dykstra et al. | |
| 2011/0297384 | A1 | 12/2011 | Fripp et al. | |
| 2011/0297385 | A1 | 12/2011 | Dykstra et al. | |
| 2012/0048563 | A1 | 3/2012 | Holderman | |
| 2012/0060624 | A1 | 3/2012 | Dykstra | |
| 2012/0061088 | A1 | 3/2012 | Dykstra et al. | |
| 2012/0111577 | A1 | 5/2012 | Dykstra et al. | |
| 2012/0125120 | A1 | 5/2012 | Dykstra | |
| 2012/0138304 | A1 | 6/2012 | Dykstra et al. | |
| 2012/0152527 | A1 | 6/2012 | Dykstra et al. | |
| 2012/0255739 | A1 | 10/2012 | Fripp et al. | |

FOREIGN PATENT DOCUMENTS

| | | | |
|---|---|---|---|
| EP | 2146049 | A2 | 1/2010 |
| WO | 0214647 | A1 | 2/2002 |
| WO | 03062597 | A1 | 7/2003 |
| WO | 2008024645 | A2 | 2/2008 |
| WO | 2009052076 | A2 | 4/2009 |
| WO | 2009052103 | A2 | 4/2009 |
| WO | 2009052149 | A2 | 4/2009 |
| WO | 2009081088 | A2 | 7/2009 |
| WO | 2009088292 | A1 | 7/2009 |
| WO | 2009088293 | A1 | 7/2009 |
| WO | 2009088624 | A2 | 7/2009 |
| WO | 2010053378 | A2 | 5/2010 |
| WO | 2010087719 | A1 | 8/2010 |
| WO | 2011095512 | A2 | 8/2011 |
| WO | 2011115494 | A1 | 9/2011 |
| WO | 2012033638 | A2 | 3/2012 |

OTHER PUBLICATIONS

International Search Report with Written Opinion issued Mar. 26, 2012 for PCT Patent Application No. PCT/US11/048986, 9 pages.

Office Action issued Nov. 2, 2011 for U.S. Appl. No. 12/792,146, 34 pages.

Office Action issued Nov. 3, 2011 for U.S. Appl. No. 13/111,169, 16 pages.

Office Action issued Nov. 2, 2011 for U.S. Appl. No. 12/792,117, 35 pages.

Office Action issued Oct. 27, 2011 for U.S. Appl. No. 12/791,993, 15 pages.

Lee Precision Micro Hydraulics, Lee Restrictor Selector product brochure; Jan. 2011, 9 pages.

Tesar, V.; Fluidic Valves for Variable-Configuration Gas Treatment; Chemical Engineering Research and Design journal; Sep. 2005; pp. 1111-1121, 83(A9); Trans IChemE; Rugby, Warwickshire, UK.

Tesar, V.; Sampling by Fluidics and Microfluidics; Acta Polytechnica; Feb. 2002; pp. 41-49; vol. 42; The University of Sheffield; Sheffield, UK.

Tesar, V., Konig, A., Macek, J., and Baumruk, P.; New Ways of Fluid Flow Control in Automobiles: Experience with Exhaust Gas Aftertreament Control; 2000 FISITA World Automotive Congress; Jun. 12-15, 2000; 8 pages; F2000H192; Seoul, Korea.

International Search Report and Written Opinion issued Mar. 25, 2011 for International Patent Application Serial No. PCT/US2010/044409, 9 pages.

International Search Report and Written Opinion issued Mar. 31, 2011 for International Patent Application Serial No. PCT/US2010/044421, 9 pages.

Office Action issued Jun. 26, 2011 for U.S. Appl. No. 12/791,993, 17 pages.

Office Action issued Oct. 26, 2011 for U.S. Appl. No. 13/111,169, 28 pages.

Stanley W. Angrist; "Fluid Control Devices", Scientific American Magazine, dated Dec. 1964, 8 pages.

Rune Freyer et al.; "An Oil Selective Inflow Control System", Society of Petroleum Engineers Inc. paper, SPE 78272, dated Oct. 29-31, 2002, 8 pages.

Stanley W. Angrist; "Fluid Control Devices", published Dec. 1964, 5 pages.

Office Action issued Mar. 7, 2012 for U.S. Appl. No. 12/792,117, 40 pages.

Office Action issued Mar. 8, 2012 for U.S. Appl. No. 12/792,146, 26 pages.

International Search Report and Written Opinion issued Mar. 27, 2012 for International Patent Application Serial No. PCT/US2012/030641, 9 pages.

Office Action issued May 24, 2012 for U.S. Appl. No. 12/869,836, 60 pages.

Office Action issued Jun. 19, 2012 for U.S. Appl. No. 13/111,169, 17 pages.

Specification and Drawings for U.S. Appl. No. 13/495,078, filed Jun. 13, 2012, 39 pages.
Joseph M. Kirchner, "Fluid Amplifiers", 1996, 6 pages, McGraw-Hill, New York.
Joseph M. Kirchner, et al., "Design Theory of Fluidic Components", 1975, 9 pages, Academic Press, New York.
Microsoft Corporation, "Fluidics" article, Microsoft Encarta Online Encyclopedia, copyright 1997-2009, 1 page, USA.
The Lee Company Technical Center, "Technical Hydraulic Handbook" 11th Edition, copyright 1971-2009, 7 pages, Connecticut.
Office Action issued Jul. 25, 2012 for U.S. Appl. No. 12/881,296, 61 pages.
International Search Report with Written Opinion issued Aug. 3, 2012 for PCT Patent Application No. PCT/US11/059,530, 15 pages.
International Search Report with Written Opinion issued Aug. 3, 2012 for PCT Patent Application No. PCT/US11/059,534, 14 pages.
Advisory Action issued Aug. 30, 2012 for U.S. Appl. No. 13/111,169, 15 pages.
International Search Report with Written Opinion issued Aug. 31, 2012 for PCT Patent Application No. PCT/US11/060,606, 10 pages.
Office Action issued Sep. 10, 2012 for U.S. Appl. No. 12/792,095, 59 pages.
Office Action issued Sep. 19, 2012 for U.S. Appl. No. 12/879,846, 78 pages.
Office Action issued Sep. 19, 2012 for U.S. Appl. No. 13/495,078, 29 pages.
Specifications and Drawings for U.S. Appl. No. 12/542,695, filed Aug. 18, 2009, 32 pages.

* cited by examiner

VARIABLE FLOW RESTRICTOR FOR USE IN A SUBTERRANEAN WELL

CROSS-REFERENCE TO RELATED APPLICATION

The present application is a continuation of U.S. application Ser. No. 12/869,836 filed on 27 Aug. 2010. The entire disclosure of this prior application is incorporated herein by this reference.

BACKGROUND

This disclosure relates generally to equipment utilized and operations performed in conjunction with a subterranean well and, in an example described below, more particularly provides a variable flow restrictor.

In a hydrocarbon production well, it is many times beneficial to be able to regulate flow of fluids from an earth formation into a wellbore. A variety of purposes may be served by such regulation, including prevention of water or gas coning, minimizing sand production, minimizing water and/or gas production, maximizing oil production, balancing production among zones, etc.

Therefore, it will be appreciated that advancements in the art of variably restricting fluid flow in a well would be desirable in the circumstances mentioned above, and such advancements would also be beneficial in a wide variety of other circumstances.

SUMMARY

In the disclosure below, a variable flow resistance system is provided which brings improvements to the art of variably restricting fluid flow in a well. One example is described below in which a flow chamber is provided with structures which cause a restriction to flow through the chamber to increase as a ratio of undesired to desired fluid in a fluid composition increases.

In one aspect, this disclosure provides to the art a variable flow resistance system for use in a subterranean well. The system can include a flow chamber through which a fluid composition flows. The chamber has at least one inlet, an outlet, and at least one structure spirally oriented relative to the outlet. The structure induces spiral flow of the fluid composition about the outlet.

In another aspect, a variable flow resistance system for use in a subterranean well can include a flow chamber including an outlet, at least one structure which induces spiral flow of a fluid composition about the outlet, and at least one other structure which impedes a change in direction of flow of the fluid composition radially toward the outlet.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
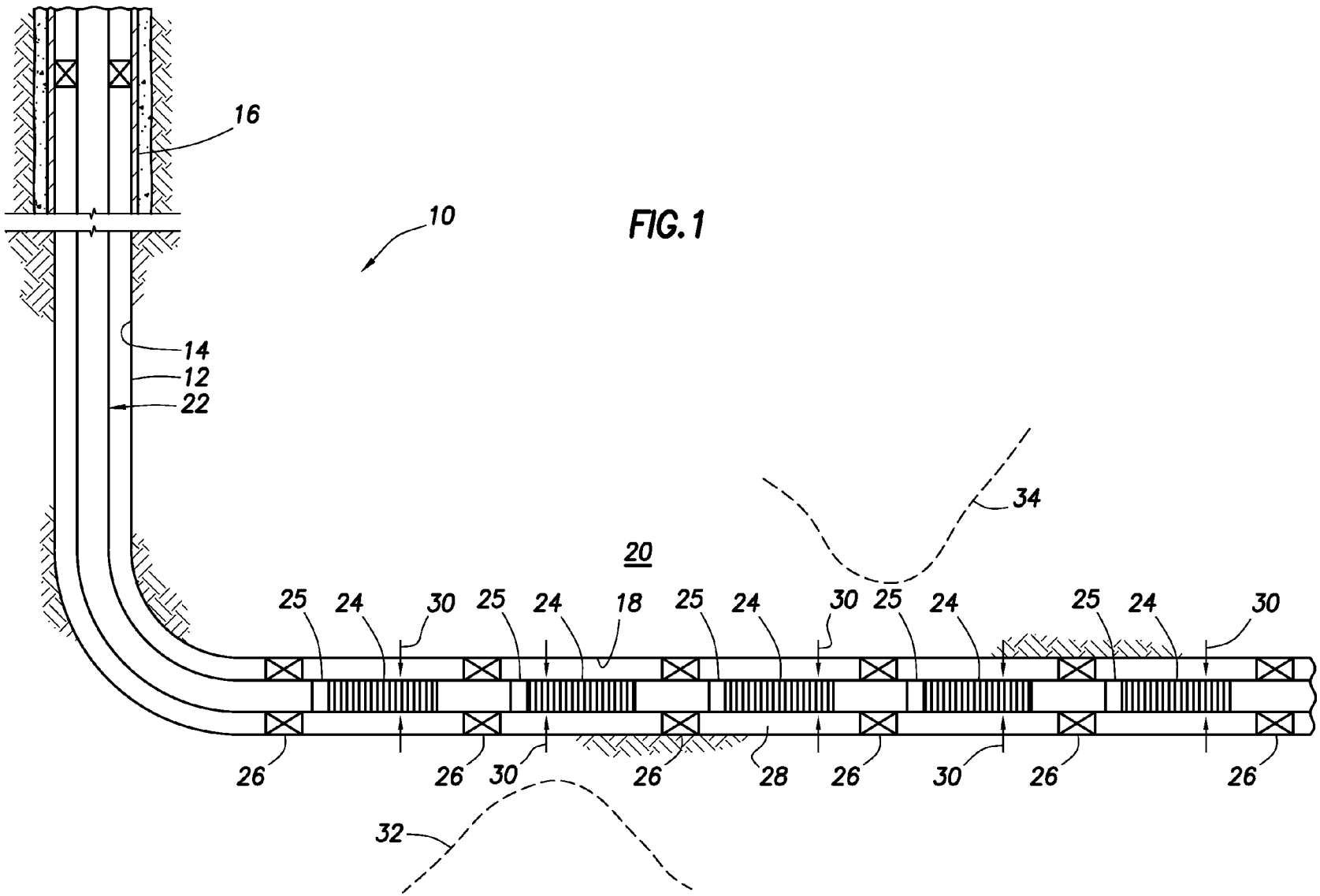
FIG. 1 is a schematic partially cross-sectional view of a well system which can embody principles of the present disclosure.

Representatively illustrated in FIG. 1 is a well system 10 which can embody principles of this disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25 and packers 26.

The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), or increasing resistance to flow if a fluid viscosity decreases below a selected level (e.g., to thereby restrict flow of an undesired fluid, such as water or gas, in an oil producing well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
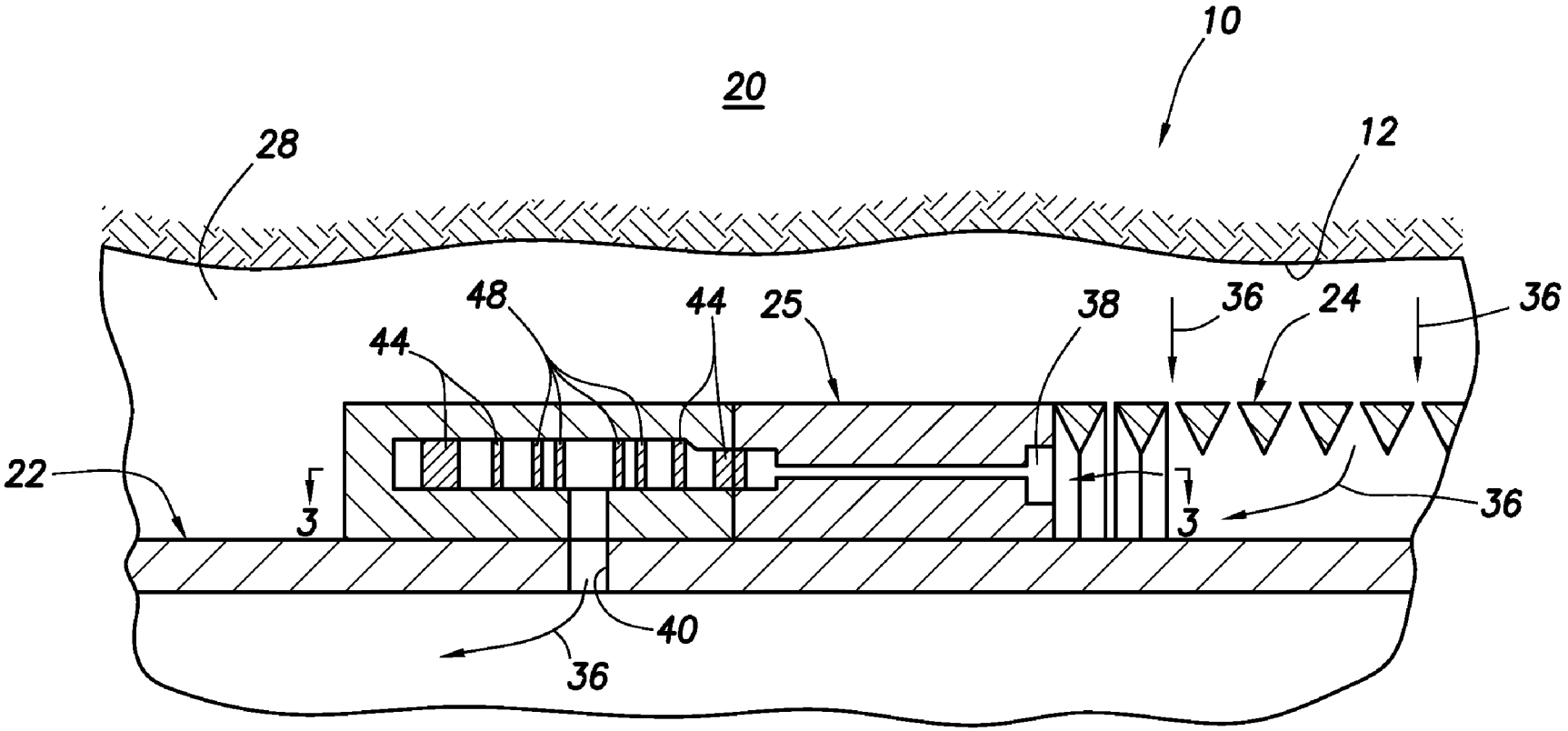
FIG. 2 is an enlarged scale cross-sectional view of a portion of the well system.

Referring additionally now to FIG. 2, an enlarged scale cross-sectional view of one of the variable flow resistance systems 25 and a portion of one of the well screens 24 is representatively illustrated. In this example, a fluid composition 36 (which can include one or more fluids, such as oil and water, liquid water and steam, oil and gas, gas and water, oil, water and gas, etc.) flows into the well screen 24, is thereby filtered, and then flows into an inlet 38 of the variable flow resistance system 25.

A fluid composition can include one or more undesired or desired fluids. Both steam and water can be combined in a fluid composition. As another example, oil, water and/or gas can be combined in a fluid composition.

Flow of the fluid composition 36 through the variable flow resistance system 25 is resisted based on one or more characteristics (such as viscosity, velocity, etc.) of the fluid composition. The fluid composition 36 is then discharged from the variable flow resistance system 25 to an interior of the tubular string 22 via an outlet 40.

In other examples, the well screen 24 may not be used in conjunction with the variable flow resistance system 25 (e.g., in injection operations), the fluid composition 36 could flow in an opposite direction through the various elements of the well system 10 (e.g., in injection operations), a single variable flow resistance system could be used in conjunction with multiple well screens, multiple variable flow resistance systems could be used with one or more well screens, the fluid composition could be received from or discharged into regions of a well other than an annulus or a tubular string, the fluid composition could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in FIG. 2 and described herein.

Although the well screen 24 depicted in FIG. 2 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the outlet 40 is parallel to the axis of the tubular string. The system 25 could be on a logging string or attached to a device that is not tubular in shape. Any orientation or configuration of the system 25 may be used in keeping with the principles of this disclosure.

Figure 3A:
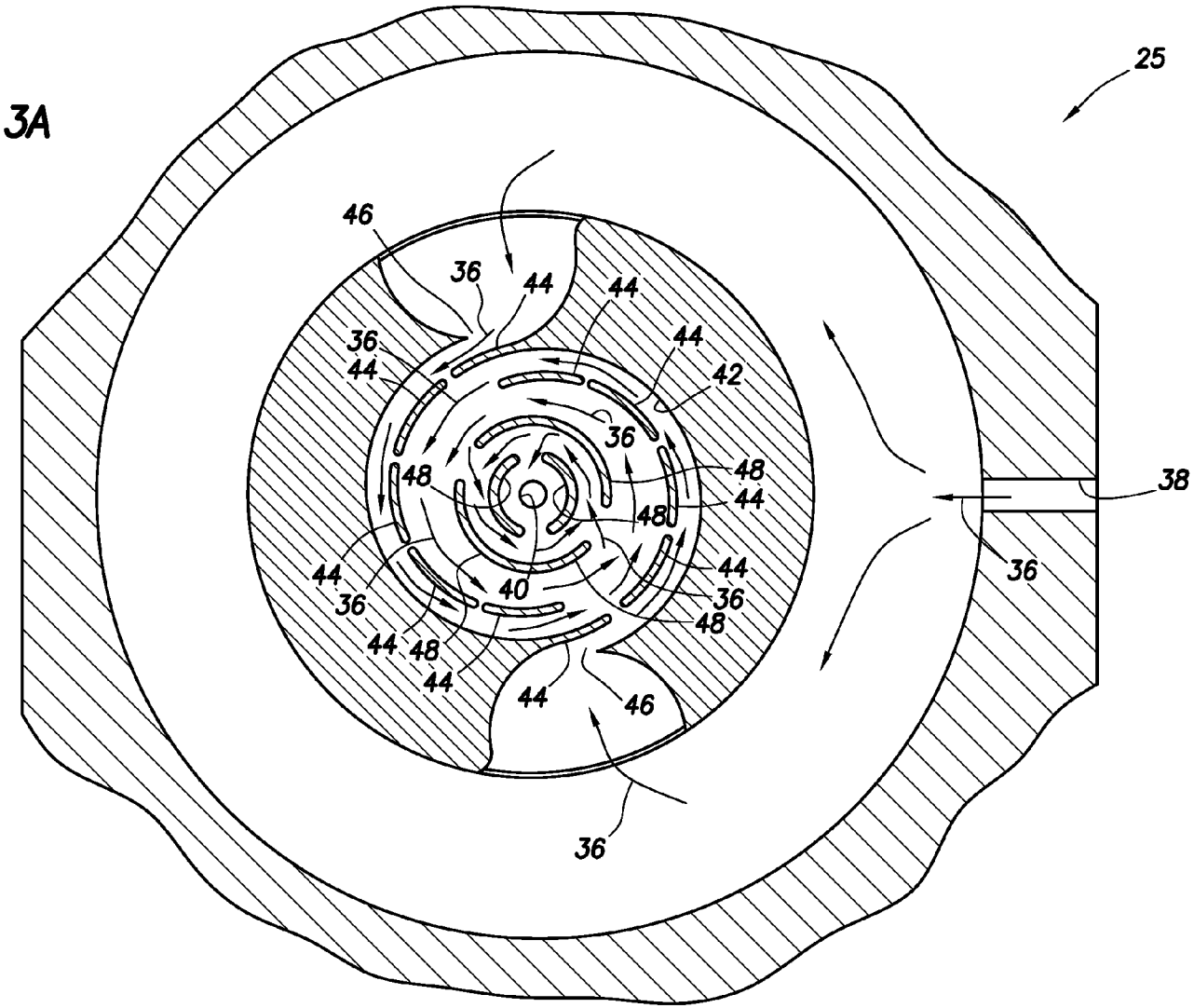
FIGS. 3A & B are further enlarged scale cross-sectional views of a variable flow resistance system, taken along line 3-3 of FIG. 2, with FIG. 3A depicting relatively high velocity, low density flow through the system, and FIG. 3B depicting relatively low velocity, high density flow through the system.

Referring additionally now to FIGS. 3A & B, more detailed cross-sectional views of one example of the system 25 is representatively illustrated. The system 25 is depicted in FIGS. 3A & B as if it is planar in configuration, but the system could instead extend circumferentially, such as in a sidewall of a tubular member, if desired.

FIG. 3A depicts the variable flow resistance system 25 with the fluid composition 36 flowing through a flow chamber 42 between the inlet 38 and the outlet 40. In FIG. 3A, the fluid composition 36 has a relatively low viscosity and/or a relatively high velocity. For example, if gas or water is an undesired fluid and oil is a desired fluid, then the fluid composition 36 in FIG. 3A has a relatively high ratio of undesired fluid to desired fluid.

Note that the flow chamber 42 is provided with structures 44 which induce a spiraling flow of the fluid composition 36 about the outlet 40. That is, the fluid composition 36 is made to flow somewhat circularly about, and somewhat radially toward, the outlet 40.

Preferably, the structures 44 also impede a change in direction of the fluid composition 36 radially toward the outlet 40. Thus, although the spiral flow of the fluid composition 36 induced by the structures 44 does have both a circular and a radial component, the structures preferably impede an increase in the radial component.

In the example of FIG. 3A, the structures 44 are spaced apart from each other in the direction of flow of the fluid composition 36. The spacing between the structures 44 preferably decreases incrementally in the direction of flow of the fluid composition 36.

Two entrances 46 to the chamber 42 are depicted in FIG. 3A, with each entrance having a series of the spaced apart structures 44 associated therewith. However, it will be appreciated that any number of entrances 46 and structures 44 may be provided in keeping with the principles of this disclosure.

Additional structures 48 are provided in the chamber 42 for impeding a change toward radial flow of the fluid composition 36. As depicted in FIG. 3A, the structures 48 are circumferentially and radially spaced apart from each other.

The spacings between the structures 44, 48 do eventually allow the fluid composition 36 to flow to the outlet 40, but energy is dissipated due to the spiraling and circular flow of the fluid composition about the outlet, and so a relatively large resistance to flow is experienced by the fluid composition. As the viscosity of the fluid composition 36 decreases and/or as the velocity of the fluid composition increases (e.g., due to a decreased ratio of desired to undesired fluids in the fluid composition), this resistance to flow will increase. Conversely, as the viscosity of the fluid composition 36 increases and/or as the velocity of the fluid composition decreases (e.g., due to an increased ratio of desired to undesired fluids in the fluid composition), this resistance to flow will decrease.

Figure 3B:
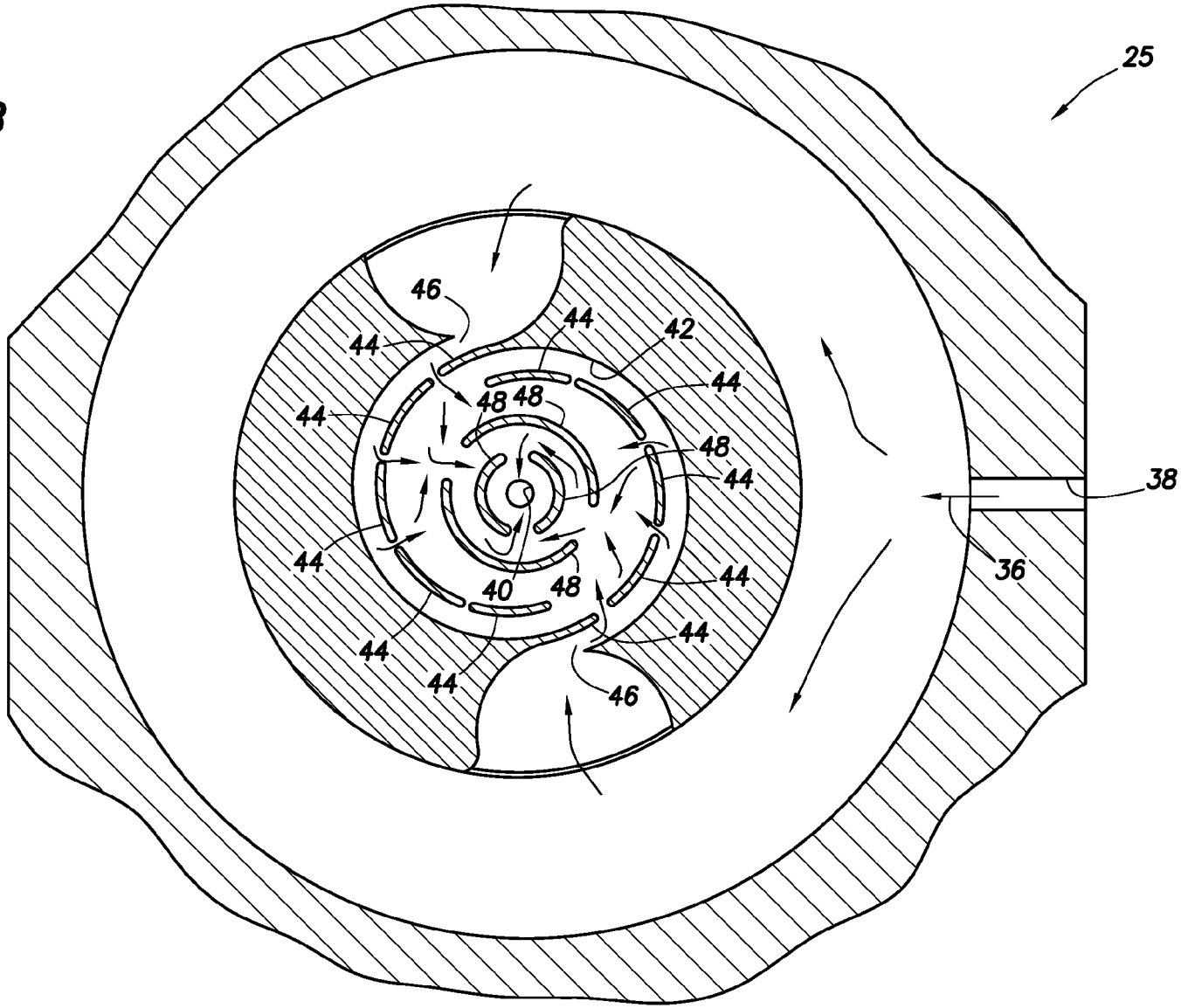

In FIG. 3B, the system 25 is depicted with such an increased ratio of desired to undesired fluids in the fluid composition 36. Having a higher viscosity and/or lower velocity, the fluid composition 36 is able to more readily flow through the spacings between the structures 44, 48.

In this manner, the fluid composition 36 flows much more directly to the outlet 40 in the FIG. 3B example, as compared to the FIG. 3A example. There is some spiral flow of the fluid composition in the FIG. 3B example, but it is much less than that in the FIG. 3A example. Thus, the energy dissipation and resistance to flow is much less in the FIG. 3B example, as compared to the FIG. 3A example.

Figure 4:
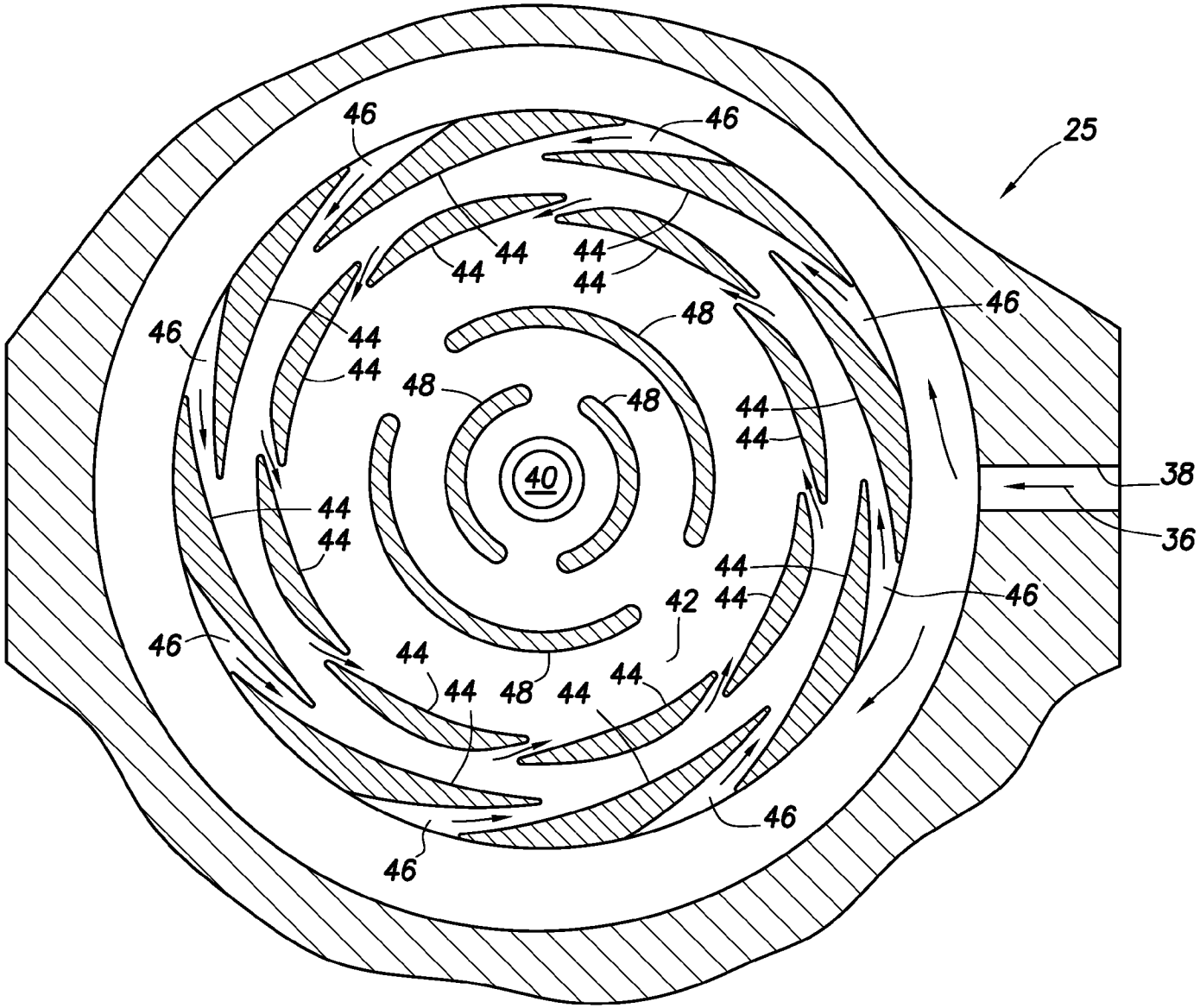
FIG. 4 is a cross-sectional view of another configuration of the variable flow resistance system.

Referring additionally now to FIG. 4, another configuration of the variable flow resistance system 25 is representatively illustrated. In this configuration, there are many more entrances 46 to the chamber 42 as compared to the configuration of FIGS. 3A & B, and there are two radially spaced apart sets of the spiral flow-inducing structures 44. Thus, it will be appreciated that a wide variety of different configurations of variable flow resistance systems may be constructed, without departing from the principles of this disclosure.

Note that the entrances 46 gradually narrow in the direction of flow of the fluid composition 36. This narrowing of flow area increases the velocity of the fluid composition 36 somewhat.

As with the configuration of FIGS. 3A & B, the resistance to flow through the system 25 of FIG. 4 will increase as the viscosity of the fluid composition 36 decreases and/or as the velocity of the fluid composition increases. Conversely, the resistance to flow through the system 25 of FIG. 4 will decrease as the viscosity of the fluid composition 36 increases and/or as the velocity of the fluid composition decreases.

In each of the configurations described above, the structures 44 and/or 48 may be formed as vanes or as recesses on one or more walls of the chamber 42. If formed as vanes, the structures 44 and/or 48 may extend outwardly from the chamber 42 wall(s). If formed as recesses, the structures 44 and/or 48 may extend inwardly from the chamber 42 wall(s). The functions of inducing a desired direction of flow of the fluid composition 36, or of resisting a change in direction of the fluid composition flow, may be performed with any types, numbers, spacings or configurations of structures.

It may now be fully appreciated that the above disclosure provides significant advancements to the art of variably restricting flow of fluid in a well. Preferably, the variable flow resistance system 25 examples described above operate autonomously, automatically and without any moving parts to reliably regulate flow between a formation 20 and an interior of a tubular string 22.

In one aspect, the above disclosure describes a variable flow resistance system 25 for use in a subterranean well. The system 25 can include a flow chamber 42 through which a fluid composition 36 flows. The chamber 42 has at least one inlet 38, an outlet 40, and at least one structure 44 spirally oriented relative to the outlet 40, whereby the structure 44 induces spiral flow of the fluid composition 36 about the outlet 40.

In another aspect, a variable flow resistance system 25 described above comprises a flow chamber 42 including an outlet 40, at least one structure 44 which induces spiral flow of a fluid composition 36 about the outlet 40, and at least one other structure 48 which impedes a change in direction of flow of the fluid composition 36 radially toward the outlet 40.

The fluid composition 36 preferably flows through the flow chamber 42 in the well.

The structure 48 increasingly impedes the change in direction radially toward the outlet 40 in response to at least one of a) increased velocity of the fluid composition 36, b) decreased viscosity of the fluid composition 36, and c) a reduced ratio of desired fluid to undesired fluid in the fluid composition 36.

The structure 44 and/or 48 can comprises at least one of a vane and a recess. The structure 44 and/or 48 can project at least one of inwardly and outwardly relative to a wall of the chamber 42.

The structure 44 and/or 48 can comprise multiple spaced apart structures. A spacing between adjacent structures 44 may decrease in a direction of spiral flow of the fluid composition 36.

The fluid composition 36 preferably flows more directly to the outlet 40 as a viscosity of the fluid composition 36 increases, as a velocity of the fluid composition 36 decreases, and/or as a ratio of desired fluid to undesired fluid in the fluid composition 36 increases.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A variable flow resistance system for use in a subterranean well, the system comprising:

a flow chamber through which a fluid composition flows, the chamber having at least one inlet through which the fluid composition enters the chamber, an outlet through which the same fluid composition exits the chamber, and at least one structure within the chamber, wherein the structure is spirally oriented relative to the outlet, whereby the structure induces spiral flow of the fluid composition about the outlet.

2. The system of claim 1, wherein the fluid composition flows through the flow chamber in the well.

3. The system of claim 1, wherein the structure impedes a change in direction of flow of the fluid composition radially toward the outlet.

4. The system of claim 3, wherein the structure increasingly impedes the change in direction radially toward the outlet in response to at least one of a) increased velocity of the fluid composition, b) decreased viscosity of the fluid composition, and c) a reduced ratio of desired fluid to undesired fluid in the fluid composition.

5. The system of claim 1, wherein the structure comprises at least one of a vane and a recess.

6. The system of claim 1, wherein the structure projects at least one of inwardly and outwardly relative to a wall of the chamber.

7. The system of claim 1, wherein the at least one structure comprises multiple spaced apart structures.

8. The system of claim 7, wherein a spacing between adjacent structures decreases in a direction of spiral flow of the fluid composition.

9. The system of claim 1, wherein the fluid composition flows more directly from the inlet to the outlet as a viscosity of the fluid composition increases.

10. The system of claim 1, wherein the fluid composition flows more directly from the inlet to the outlet as a velocity of the fluid composition decreases.

11. The system of claim 1, wherein the fluid composition flows more directly from the inlet to the outlet as a ratio of desired fluid to undesired fluid in the fluid composition increases.

* * * * *